US010584463B2

(12) United States Patent
Matsuyama et al.

(10) Patent No.: US 10,584,463 B2
(45) Date of Patent: Mar. 10, 2020

(54) CONTROL DEVICE FOR CONSTRUCTION MACHINE AND METHOD OF CONTROLLING CONSTRUCTION MACHINE

(71) Applicant: Komatsu Ltd., Tokyo (JP)

(72) Inventors: Toru Matsuyama, Tokyo (JP); Jin Kitajima, Tokyo (JP); Yuki Shimano, Tokyo (JP)

(73) Assignee: Komatsu Ltd., Tokyo (JP)

( * ) Notice: Subject to any disclaimer, the term of this patent is extended or adjusted under 35 U.S.C. 154(b) by 46 days.

(21) Appl. No.: 15/516,778

(22) PCT Filed: Nov. 29, 2016

(86) PCT No.: PCT/JP2016/085455

§ 371 (c)(1),
(2) Date: Apr. 4, 2017

(87) PCT Pub. No.: WO2017/086488

PCT Pub. Date: May 26, 2017

(65) Prior Publication Data

US 2018/0230672 A1 Aug. 16, 2018

(51) Int. Cl.
*E02F 3/43* (2006.01)
*E02F 3/42* (2006.01)
(Continued)

(52) U.S. Cl.
CPC ..... *E02F 3/436* (2013.01); *E02F 3/425* (2013.01); *E02F 3/437* (2013.01); *E02F 9/265* (2013.01); *E02F 3/439* (2013.01); *E02F 9/2012* (2013.01)

(58) Field of Classification Search
CPC ... E02F 3/43; E02F 3/431; E02F 3/432; E02F 3/433; E02F 3/434; E02F 3/435;
(Continued)

(56) References Cited

U.S. PATENT DOCUMENTS 2,883,077 A * 4/1959 Pilch ..... E02F 3/3408 414/700
4,844,685 A * 7/1989 Sagaser ..... E02F 3/43 414/700
(Continued)

FOREIGN PATENT DOCUMENTS

DE 112008003479 T5 1/2011
DE 112013000165 T5 12/2014
(Continued)

OTHER PUBLICATIONS

International Search Report dated Feb. 28, 2017, issued for PCT/JP2016/085455.
(Continued)

*Primary Examiner* — Peter D Nolan
*Assistant Examiner* — Sara J Lewandroski
(74) *Attorney, Agent, or Firm* — Locke Lord LLP

(57) ABSTRACT

A control device for a construction machine includes an operational amount data acquisition unit configured to acquire operational amount data indicating an operational amount of the working unit, an operation determination unit configured to determine a non-operation state of a bucket on the basis of the operational amount data, a bucket control determination unit configured to determine whether bucket control conditions are satisfied, on the basis of determination of the non-operation state, and a working unit control unit configured to output a control signal for controlling the bucket to maintain a state of the working unit, when the bucket control conditions are determined to be satisfied.

6 Claims, 9 Drawing Sheets

(51) Int. Cl.
*E02F 9/26* (2006.01)
*E02F 9/20* (2006.01)

(58) Field of Classification Search
CPC ..... E02F 3/436; E02F 3/437; E02F 3/439; B60W 2300/17; F16C 2350/26; G05B 2219/45012; G05B 2219/40426
See application file for complete search history.

(56) References Cited

U.S. PATENT DOCUMENTS 5,083,894 A * 1/1992 Ikari ..... E02F 3/433 414/700
5,116,186 A * 5/1992 Hanamoto ..... E02F 3/438 37/348
5,688,101 A * 11/1997 Kim ..... E02F 3/3408 414/713
5,794,369 A * 8/1998 Lee ..... E02F 3/437 37/348
9,464,406 B2 10/2016 Matsuyama et al.
2004/0060711 A1* 4/2004 Charles ..... E02F 3/432 172/2
2004/0083628 A1* 5/2004 Hendron ..... E02F 3/433 37/348
2005/0241193 A1* 11/2005 Burgin ..... E02F 3/432 37/348
2006/0291987 A1* 12/2006 Osanai ..... B66F 9/065 414/685
2009/0159302 A1 6/2009 Koch et al.
2010/0226744 A1* 9/2010 Trifunovic ..... E02F 3/432 414/700
2012/0315120 A1* 12/2012 Hyder ..... E02F 3/34 414/699
2012/0321425 A1* 12/2012 Shatters ..... E02F 3/432 414/700
2014/0064898 A1* 3/2014 Nishi ..... E02F 3/3417 414/685
2014/0142817 A1* 5/2014 Matsuyama ..... E02F 3/437 701/50
2015/0039189 A1* 2/2015 Wu ..... E02F 9/2075 701/50
2015/0240445 A1* 8/2015 Guo ..... E02F 3/435 701/50
2015/0275469 A1* 10/2015 Fredrickson ..... E02F 3/3414 414/685
2015/0275471 A1* 10/2015 Matsumoto ..... E02F 3/3417 701/50
2016/0040398 A1 2/2016 Kitajima et al.
2016/0054739 A1* 2/2016 Palmroth ..... A01G 23/00 701/50
2016/0097184 A1 4/2016 Matsuyama et al.
2017/0036899 A1* 2/2017 Singh ..... B66F 9/22
2017/0121930 A1 5/2017 Kitajima et al.
2017/0226758 A1* 8/2017 Meinert ..... E04G 21/0463
2017/0298592 A1* 10/2017 Akanda ..... E02F 3/308
2017/0314234 A1* 11/2017 Paull ..... E02F 3/301
2018/0016768 A1* 1/2018 Izumikawa ..... E02F 3/435
2018/0266083 A1* 9/2018 Narikawa ..... E02F 3/435

FOREIGN PATENT DOCUMENTS

JP 2002-167794 A 6/2002
WO 2014/167718 A1 10/2014
WO 2015137528 A1 9/2015
WO 2016/148311 A1 9/2016

OTHER PUBLICATIONS

Office Action dated Feb. 13, 2019 in the corresponding German patent application No. 112016000156.8.

* cited by examiner

CONTROL DEVICE FOR CONSTRUCTION MACHINE AND METHOD OF CONTROLLING CONSTRUCTION MACHINE

FIELD

The present invention relates to a control device for a construction machine and a method of controlling a construction machine.

BACKGROUND

In a technical field relating to construction machines such as excavators, a construction machine is known which has a working unit controlled to move a bucket along a target excavation profile indicating a target shape of an object to be excavated, as disclosed in Patent Literature 1.

CITATION LIST

Patent Literature

Patent Literature 1: WO 2014/167718

SUMMARY

Technical Problem

For example, for finish excavation of the object to be excavated, the working unit is desired to be driven while maintaining an angle of the bucket at a constant angle relative to the target excavation profile. However, when the bucket is always controlled at a constant angle, operation of an operation device by an operator is not reflected on driving the bucket, and feeling of strangeness is provided to the operator.

An object of an aspect of the present invention is to provide a control device for a construction machine which can start control of a bucket in angle at appropriate time, and a method of controlling a construction machine.

Solution to Problem

According to a first aspect of the present invention, a control device for a construction machine including a working unit including at least a bucket, the control device for a construction machine comprises: an operational amount data acquisition unit configured to acquire operational amount data indicating an operational amount of the working unit; an operation determination unit configured to determine a non-operation state of the bucket on the basis of the operational amount data; a bucket control determination unit configured to determine whether bucket control conditions are satisfied, on the basis of determination of the non-operation state; and a working unit control unit configured to output a control signal for controlling the bucket to maintain a state of the working unit, when the bucket control conditions are determined to be satisfied.

According to a second aspect of the present invention, a method of controlling a construction machine including a working unit including at least a bucket, the method of controlling a construction machine comprises: acquiring operational amount data indicating an operational amount of the working unit; determining a non-operation state of the bucket on the basis of the operational amount data; determining whether bucket control conditions are satisfied, on the basis of determination of the non-operation state; and outputting a control signal for controlling the bucket to maintain a state of the working unit, when the bucket control conditions are determined to be satisfied.

Advantageous Effects of Invention

According to an aspect of the present invention, provided is the control device for a construction machine which can start control of the bucket in angle at appropriate time, and the method of controlling a construction machine.

DESCRIPTION OF EMBODIMENTS

Embodiments according to the present invention will be described below with reference to the drawings, but the present invention is not limited thereto. Component elements described according to the embodiments can be appropriately combined with each other. Furthermore, some of the component elements may not be used.

[Construction Machine]

Figure 1:
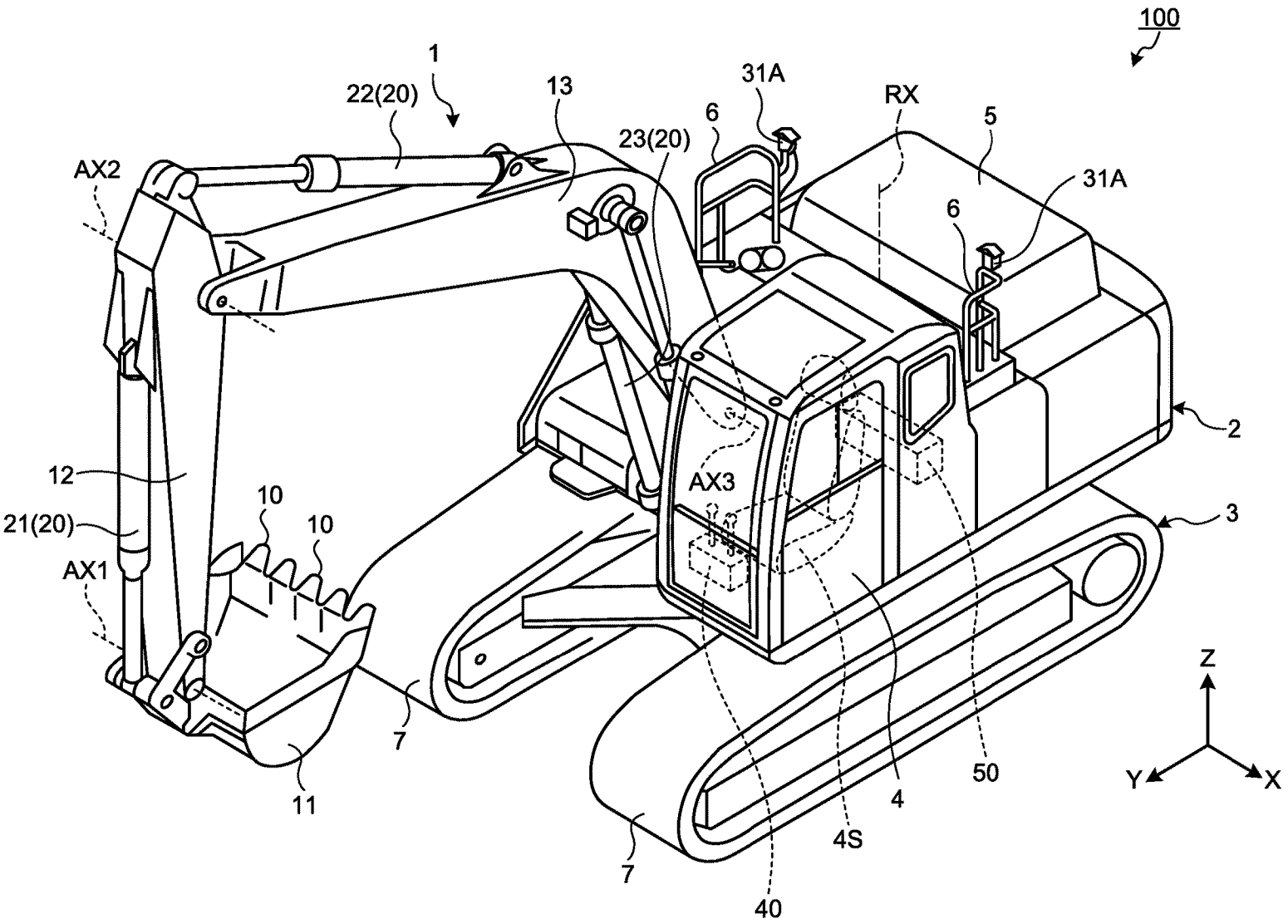
FIG. 1 is a perspective view illustrating an example of an excavator according to the present embodiment.

FIG. 1 is a perspective view illustrating an example of a construction machine 100 according to the present embodiment. In the present embodiment, an example of the construction machine 100 as an excavator will be described. In the following description, the construction machine 100 is appropriately referred to as excavator 100.

As illustrated in FIG. 1, the excavator 100 includes a working unit 1 operated by hydraulic pressure, a vehicle body 2 for supporting the working unit 1, a travel unit 3 for supporting the vehicle body 2, an operation device 40 for operating the working unit 1, and a control device 50 for controlling the working unit 1. The vehicle body 2 can swing about a swing axis RX, while being supported by the travel unit 3. The vehicle body 2 is disposed above the travel unit 3. In the following description, the vehicle body 2 is appropriately referred to as upper swing body 2, and the travel unit 3 is appropriately referred to as lower travel body 3.

The upper swing body 2 has a cab 4 for an operator to get in, a machine room 5 for storing an engine, a hydraulic pump, and the like, and hand rails 6. The cab 4 has a driver's seat 4S on which the operator sits. The machine room 5 is disposed in back of the cab 4. The hand rails 6 are disposed in front of the machine room 5.

The lower travel body 3 has a pair of tracks 7. The tracks 7 are rotated, and the excavator 100 travels. Note that the lower travel body 3 may have wheels (tires).

The working unit 1 is supported by the upper swing body 2. The working unit 1 has a bucket 11 having a cutting edge 10, an arm 12 connected to the bucket 11, and a boom 13 connected to the arm 12. The cutting edge 10 of the bucket 11 may be an edge portion of projecting teeth provided at the bucket 11. The cutting edge 10 of the bucket 11 may be an edge portion of a straight blade provided at the bucket 11.

The bucket 11 is connected to an end portion of the arm 12. A base end portion of the arm 12 is connected to an end portion of the boom 13. A base end portion of the boom 13 is connected to the upper swing body 2.

The bucket 11 and the arm 12 are connected to each other through a bucket pin. The bucket 11 is supported by the arm 12 to be rotatable about a rotation axis AX1. The arm 12 and the boom 13 are connected to each other through an arm pin. The arm 12 is supported by the boom 13 to be rotatable about a rotation axis AX2. The boom 13 and the upper swing body 2 are connected to each other through a boom pin. The boom 13 is supported by the vehicle body 2 to be rotatable about a rotation axis AX3.

The rotation axis AX1, the rotation axis AX2, and the rotation axis AX3 are parallel with each other. The rotation axes AX1, AX2, and AX3 and an axis parallel with the swing axis RX are orthogonal to each other. In the following description, axis directions of the rotation axes AX1, AX2, and AX3 are appropriately referred to as a vehicle width direction of the upper swing body 2, and a direction orthogonal to both of the rotation axes AX1, AX2, and AX3 and the swing axis RX is appropriately referred to as a longitudinal direction of the upper swing body 2. A forward direction represents a direction toward the working unit 1 relative to the operator on the driver's seat 4S.

Note that the bucket 11 may be a tilt bucket. The tilt bucket is a bucket tiltable in the vehicle width direction by operating the bucket tilt cylinder. When the excavator 100 is operated on sloping ground, the bucket 11 is tilted in the vehicle width direction to freely shape or level a slope or flat ground.

The operation device 40 is disposed in the cab 4. The operation device 40 includes an operation member operated by the operator of the excavator 100. The operation member includes an operation lever or a joystick. The operation member is operated to operate the working unit 1.

The control device 50 includes a computer system. The control device 50 has a processor such as a central processing unit (CPU), a storage device such as a read only memory (ROM) or a random access memory (RAM), and an input-output interface device.

Figure 2:
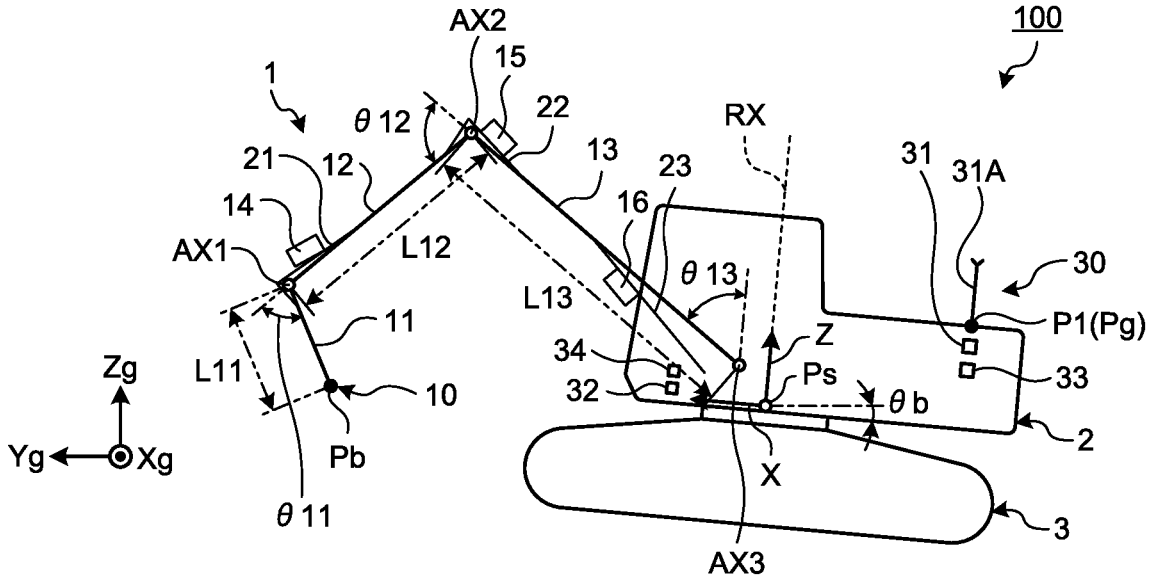
FIG. 2 is a schematic side view illustrating an example of the excavator according to the present embodiment.

FIG. 2 is a schematic side view illustrating the excavator 100 according to the present embodiment. As illustrated in FIGS. 1 and 2, the excavator 100 has hydraulic cylinders 20 for driving the working unit 1. The hydraulic cylinders 20 are driven by hydraulic oil. The hydraulic cylinders 20 include a bucket cylinder 21 for driving the bucket 11, an arm cylinder 22 for driving the arm 12, and a boom cylinder 23 for driving the boom 13.

As illustrated in FIG. 2, the excavator 100 has a bucket cylinder stroke sensor 14 disposed at the bucket cylinder 21, an arm cylinder stroke sensor 15 disposed at the arm cylinder 22, and a boom cylinder stroke sensor 16 disposed at the boom cylinder 23. The bucket cylinder stroke sensor 14 detects a bucket cylinder length as a stroke length of the bucket cylinder 21. The arm cylinder stroke sensor 15 detects an arm cylinder length as a stroke length of the arm cylinder 22. The boom cylinder stroke sensor 16 detects a boom cylinder length as a stroke length of the boom cylinder 23.

The excavator 100 includes a position detecting device 30 for detecting a position of the upper swing body 2. The position detecting device 30 includes a vehicle body position detector 31 for detecting a position of the upper swing body 2 defined by a global coordinate system, an attitude detector 32 for detecting an attitude of the upper swing body 2, and an orientation detector 33 for detecting an orientation of the upper swing body 2.

The global coordinate system (XgYgZg coordinate system) represents a coordinate system indicating an absolute position defined by a global positioning system (GPS). A local coordinate system (XYZ coordinate system) is a coordinate system indicating a relative position with respect to a reference position Ps of the upper swing body 2 of the excavator 100. For example, the reference position Ps of the upper swing body 2 is set on the swing axis RX of the upper swing body 2. Note that the reference position Ps of the upper swing body 2 may be set on the rotation axis AX3. The position detecting device 30 detects a three-dimensional position of the upper swing body 2 defined by the global coordinate system, an attitude angle of the upper swing body 2 relative to a horizontal plane, and the orientation of the upper swing body 2 relative to a reference orientation.

The vehicle body position detector 31 includes a GPS receiver. The vehicle body position detector 31 detects the three-dimensional position of the upper swing body 2 defined by the global coordinate system. The vehicle body position detector 31 detects a position in an Xg direction, a position in a Yg direction, and a position in a Zg direction of the upper swing body 2.

The upper swing body 2 is provided with a plurality of GPS antennas 31A. Each of the GPS antennas 31A receives a radio wave from a GPS satellite, and outputs a signal based on the received radio wave to the vehicle body position detector 31. The vehicle body position detector 31 detects an installation positions P1 of the GPS antennas 31A defined by the global coordinate system, on the basis of the signal supplied from the GPS antenna 31A. The vehicle body position detector 31 detects an absolute position Pg of the upper swing body 2, on the basis of the installation positions P1 of the GPS antennas 31A.

The vehicle body position detector 31 detects an installation position P1*a* of one GPS antenna 31A of two GPS antennas 31A, and an installation position P1*b* of the other GPS antenna 31A. The vehicle body position detector 31 A performs calculation processing, on the basis of the installation position P1*a* and the installation position P1*b*, and detects the absolute position Pg and the orientation of the upper swing body 2. In the present embodiment, the absolute position Pg of the upper swing body 2 is the installation position P1*a*. Note that the absolute position Pg of the upper swing body 2 may be the installation position P1*b*.

The attitude detector 32 includes an inertial measurement unit (IMU). The attitude detector 32 is provided in the upper swing body 2. The attitude detector 32 is disposed at a lower portion of the cab 4. The attitude detector 32 detects the attitude angle of the upper swing body 2 relative to a horizontal plane (XgYg plane). The attitude angle of the upper swing body 2 relative to the horizontal plane includes an attitude angle θa of the upper swing body 2 in a vehicle width direction, and an attitude angle θb of the upper swing body 2 in a longitudinal direction.

The orientation detector 33 has a function of detecting the orientation of the upper swing body 2 relative to the reference orientation defined by the global coordinate system, on the basis of the installation position P1*a* of one GPS antenna 31A and the installation position P1*b* of the other GPS antenna 31A. The reference orientation is for example north. The orientation detector 33 performs calculation processing on the basis of the installation position P1*a* and the installation position P1*b*, and detects the orientation of the upper swing body 2 relative to the reference orientation. The orientation detector 33 calculates a straight line connecting the installation position P1*a* and the installation position P1*b*, and detects the orientation of the upper swing body 2 relative to the reference orientation, on the basis of an attitude angle θc formed between the calculated straight line and the reference orientation.

Note that the orientation detector 33 may be separated from the position detecting device 30. The orientation detector 33 may detect the orientation of the upper swing body 2, using a magnetic sensor.

The excavator 100 includes a cutting edge position detector 34 for detecting a relative position of the cutting edge 10 with respect to the reference position Ps of the upper swing body 2.

In the present embodiment, the cutting edge position detector 34 calculates the relative position of the cutting edge 10 with respect to the reference position Ps of the upper swing body 2, on the basis of a result of the detection by the bucket cylinder stroke sensor 14, a result of the detection by the arm cylinder stroke sensor 15, a result of the detection by the boom cylinder stroke sensor 16, a length L11 of the bucket 11, a length L12 of the arm 12, and a length L13 of the boom 13.

The cutting edge position detector 34 calculates an attitude angle θ11 of the cutting edge 10 of the bucket 11 relative to the arm 12, on the basis of the bucket cylinder length detected by the bucket cylinder stroke sensor 14. The cutting edge position detector 34 calculates an attitude angle θ12 of the arm 12 relative to the boom 13, on the basis of the arm cylinder length detected by the arm cylinder stroke sensor 15. The cutting edge position detector 34 calculates an attitude angle θ13 of the boom 13 relative to a Z axis of the upper swing body 2, on the basis of the boom cylinder length detected by the boom cylinder stroke sensor 16.

The length L11 of the bucket 11 is a distance between the cutting edge 10 of the bucket 11 and the rotation axis AX1 (bucket pin). The length L12 of the arm 12 is a distance between the rotation axis AX1 (bucket pin) and the rotation axis AX2 (arm pin). The length L13 of the boom 13 is a distance between the rotation axis AX2 (arm pin) and the rotation axis AX3 (boom pin).

The cutting edge position detector 34 calculates the relative position of the cutting edge 10 with respect to the reference position Ps of the upper swing body 2, on the basis of the attitude angle θ11, the attitude angle θ12, the attitude angle θ13, the length L11, the length L12, and the length L13.

Furthermore, the cutting edge position detector 34 calculates an absolute position Pb of the cutting edge 10, on the basis of the absolute position Pg of the upper swing body 2 detected by the position detecting device 30, and the relative position between the reference position Ps of the upper swing body 2 and the cutting edge 10. A relative position between the absolute position Pg and the reference position Ps is known data derived from specification data of the excavator 100. Accordingly, the cutting edge position detector 34 can calculate the absolute position Pb of the cutting edge 10, on the basis of the absolute position Pg of the upper swing body 2, the relative position between the reference position Ps of the upper swing body 2 and the cutting edge 10, and the specification data of the excavator 100.

Note that, in the present embodiment, the cylinder stroke sensors 14, 15, and 16 are used to detect the attitude angles θ11, θ12, and θ13, but the cylinder stroke sensors 14, 15, and 16 are not necessarily used. For example, the cutting edge position detector 34 may use an angle sensor, such as a potentiometer, a water level, or the like to detect the attitude angle θ11 of the bucket 11, the attitude angle θ12 of the arm 12, and the attitude angle θ13 of the boom 13.

[Operation of Working Unit]

Operation of the operation device 40 causes dumping operation of the bucket 11, excavation operation of the bucket 11, dumping operation of the arm 12, excavation operation of the arm 12, rising operation of the boom 13, and lowering operation of the boom 13.

In the present embodiment, the operation device 40 includes a right operation lever arranged on the right side of the operator on the driver's seat 4S, and a left operation lever arranged on the left side thereof. When the right operation lever is moved in a longitudinal direction, the boom 13 performs lowering operation and rising operation. When the right operation lever is moved in a transverse direction (vehicle width direction), the bucket 11 performs excavation operation and dumping operation. When the left operation lever is moved in a longitudinal direction, the arm 12 performs dumping operation and excavation operation. When the left operation lever is moved in a transverse direction, the upper swing body 2 swings rightward and leftward. Note that when the left operation lever is moved in the longitudinal direction, the upper swing body 2 may be swung right and left, and when the left operation lever is moved in the transverse direction, the arm 12 may perform dumping operation and excavation operation.

[Working Unit Control]

Figure 3:
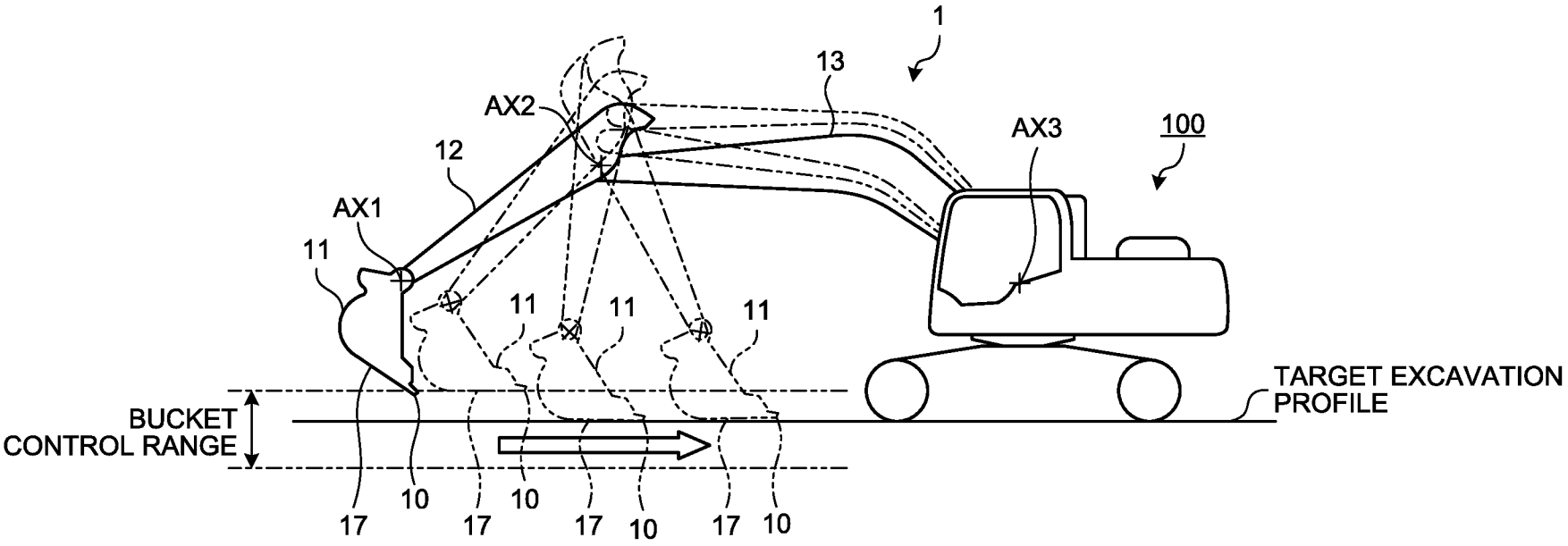
FIG. 3 is a schematic view illustrating an example of operation of a working unit driven on the basis of working unit control according to the present embodiment.

FIG. 3 is a schematic view illustrating an example of operation of the working unit 2 driven on the basis of working unit control according to the present embodiment. In the present embodiment, the working unit control includes land leveling assist control and bucket control.

As illustrated in FIG. 3, the land leveling assist control represents control of the working unit 1 to move the bucket 11 along a target excavation profile indicating a target shape of an object to be excavated. The target excavation profile may be defined by planes or lines. In the land leveling assist control, the boom cylinder 23 is controlled to cause the boom 13 to perform rising operation so that the bucket 11 does not exceed the target excavation profile.

In the land leveling assist control, the bucket 11 and the arm 12 are driven on the basis of operation of the operation device 40 by the operator. The boom 13 is driven on the basis of control by the control device 50.

The bucket control represents control of the working unit 1 to maintain a state of the working unit 1 in a constant state. In the present embodiment, the state of the working unit 1 includes an attitude of the working unit 1. The attitude of the working unit 1 includes the sum of the attitude angle θ11 of the bucket 11, the attitude angle θ12 of the arm 12, and the attitude angle θ13 of the boom 13. That is, in the present embodiment, the bucket control represents control of the working unit 1 to maintain the attitude of the working unit 1 representing the sum of the attitude angle θ11, the attitude angle θ12, and the attitude angle θ13, at a constant angle. As illustrated in FIG. 3, in the bucket control, the hydraulic cylinders 20 are controlled to maintain an angle of the bucket 11 at a constant angle relative to the target excavation profile.

In the bucket control, the arm 12 is driven on the basis of operation of the operation device 40 by the operator. The bucket 11 is driven on the basis of control by the control device 50.

As illustrated in FIG. 3, in the present embodiment, the land leveling assist control and the bucket control are performed to move the cutting edge 10 of the bucket 11 along the target excavation profile, and separate a bottom surface 17 of the bucket 11 from the target excavation profile.

When the bucket control is performed for excavation of the object to be excavated, the arm 12 is caused to perform excavation operation, and the bucket 11 is caused to perform dumping operation. While the operation of the operation device 40 causes the arm 12 to perform the excavation operation, the control device 50 causes the bucket 11 to perform dumping operation, and causes the boom 13 to perform rising operation to move the bucket 11 along the target excavation profile.

In the present embodiment, when at least part of the bucket 11 is within a bucket control range, the bucket control is performed. The bucket control range represents a range of a predetermined distance relative to the target excavation profile. In the present embodiment, when a distance D between the target excavation profile and the bucket 11 is not larger than a first threshold H1, the bucket control is performed.

[Hydraulic System]

Next, an example of a hydraulic system 300 according to the present embodiment will be described. The hydraulic cylinders 20 including the bucket cylinder 21, the arm cylinder 22, and the boom cylinder 23 are operated by the hydraulic system 300. The hydraulic cylinders 20 are operated by at least one of the operation device 40 and the control device 50.

Figure 4:
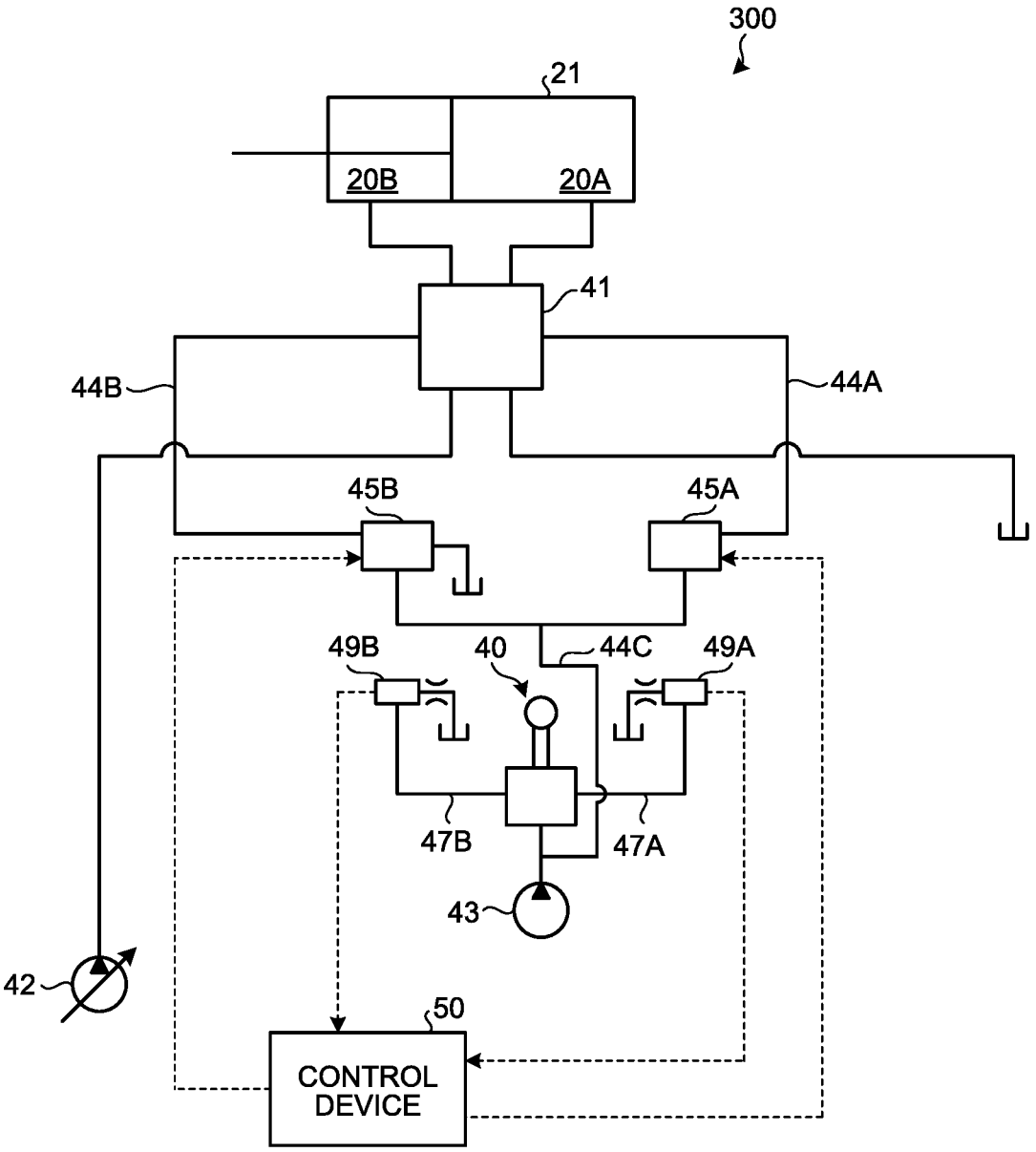
FIG. 4 is a diagram illustrating an example of a hydraulic system according to the present embodiment.

FIG. 4 is a diagram illustrating an example of the hydraulic system 300 operating the bucket cylinder 21. The bucket 11 performs two types of operations, that is, the excavation operation and the dumping operation. Extension of the bucket cylinder 21 causes the bucket 11 to perform excavation operation, and retraction of the bucket cylinder 21 causes the bucket 11 to perform dumping operation.

The hydraulic system 300 includes a variable displacement main hydraulic pump 42 for supplying hydraulic oil to the bucket cylinder 21 through a directional control valve 41, a sub-hydraulic pump 43 for supplying pilot oil, oil passages 44A, 44B, and 44C through which the pilot oil flows, control valves 45A and 45B disposed in the oil passages 44A and 44B to adjust pilot pressure applied to the directional control valve 41, oil passages 47A and 47B connected to the operation device 40, pressure sensors 49A and 49B disposed in the oil passages 47A and 47B, a restrictor disposed in the oil passages 47A and 47B, and the control device 50 for controlling the control valves 45A and 45B.

The control valves 45A and 45B are an electromagnetic proportional control valve. The control valves 45A and 45B are connected to the sub-hydraulic pump 43 through the oil passage 44C. The pilot oil delivered from the sub-hydraulic pump 43 is supplied to the control valves 45A and 45B. Note that the pilot oil delivered from the main hydraulic pump 42 may be reduced in pressure by a pressure reducing valve to be supplied to the control valves 45A and 45B. The control valves 45A and 45B adjust the pilot pressure applied to the directional control valve 41, on the basis of control signals from the control device 50. The control valve 45A adjusts the pilot pressure in the oil passage 44A. The control valve 45B adjusts the pilot pressure in the oil passage 44B. In the present embodiment, the sub-hydraulic pump 43 always supplies the pilot oil to the control valves 45A and 45B. Accordingly, even if an operation lever of the operation device 40 is in a neutral position, the pilot pressure always acts on the control valves 45A and 45B.

The directional control valve 41 controls a flow direction of the hydraulic oil and an amount of hydraulic oil to be supplied. The hydraulic oil supplied from the main hydraulic pump 42 is supplied to the bucket cylinder 21 through the directional control valve 41. The directional control valve 41 switches between supply of the hydraulic oil to a cap side oil chamber 20A of the bucket cylinder 21, and supply of the hydraulic oil to a rod side oil chamber 20B. Furthermore, the directional control valve 41 adjusts the amount of hydraulic oil to be supplied. The cap side oil chamber 20A is a space between a cylinder head cover and a piston. The rod side oil chamber 20B is a space in which a piston rod is disposed.

The operation device 40 is connected to the sub-hydraulic pump 43. The pilot oil delivered from the sub-hydraulic pump 43 is supplied to the operation device 40. Note that the pilot oil delivered from the main hydraulic pump 42 may be reduced in pressure by the pressure reducing valve to be supplied to the operation device 40.

When the operation device 40 is operated, a pressure in the oil passage 47A and a pressure in the oil passage 47B are changed, on the basis of an operational amount of the operation device 40. The pressure in the oil passage 47A is detected by the pressure sensor 49A. The pressure in the oil passage 47B is detected by the pressure sensor 49B.

Detection data from the pressure sensors 49A and 49B are output to the control device 50. On the basis of the detection data from the pressure sensors 49A and 49B, the control device 50 detects the operational amount and the operational amount of the operation device 40. On the basis of the detection data from the pressure sensors 49A and 49B, the control device 50 outputs the control signals to the control valves 45A and 45B.

On the basis of the detection data from the pressure sensors 49A and 49B, the control device 50 controls the control valves 45A and 45B so that a pilot pressure acts on the directional control valve 41 according to the operational amount and the operational direction of the operation device 40. Thus, the control device 50 can adjust the pilot pressure, on the basis of the operational amount and operational direction of the operation device 40 to adjust a movement amount and movement speed of a spool in an axis direction.

For example, when an operation lever of the operation device 40 is moved to one side from the neutral position, the pressure sensor 49A detects a pressure according to the operational amount of the operation lever. The control device 50 controls the control valve 45A so that the pilot pressure acts on the directional control valve 41 according to detection data from the pressure sensor 49A. When the operation lever of the operation device 40 is moved to the other side from the neutral position, the pressure sensor 49B detects a pressure according to the operational amount of the operation lever. The control device 50 controls the control valve 45B so that the pilot pressure acts on the directional control valve 41 according to detection data from the pressure sensor 49B.

Furthermore, the control device 50 can output the control signal to the control valves 45A and 45B and adjust the pilot pressure acting on the directional control valve 41, without depending on the operation of the operation device 40. For example, in the bucket control, on the basis of a control signal relating to the bucket control, output from the control device 50, the control valve 45A and the control valve 45B are controlled. The control valve 45A and the control valve 45B are controlled, on the basis of the control signal output from the control device 50 to perform the bucket control. Meanwhile, when the bucket control is not performed, the control valve 45A and the control valve 45B are controlled to drive the directional control valve 41 on the basis of the pilot pressure adjusted by the operation of the operation device 40.

Note that the operation device 40 may be a control device electrically driven. For example, the operation device 40 may have an operation member such as an electrical lever, and a displacement sensor such as a tiltmeter using a potentiometer for electrically detecting a tilting amount of the operation member. Detection data from the displacement sensor is output to the control device 50. The control device 50 acquires the detection data from the displacement sensor, as the operational amount of the operation device 40. The control device 50 may output a control signal for driving the directional control valve 41, on the basis of the detection data from the displacement sensor. Furthermore, the directional control valve 41 may be driven by an electrically operated actuator such as a solenoid actuator.

Figure 5:
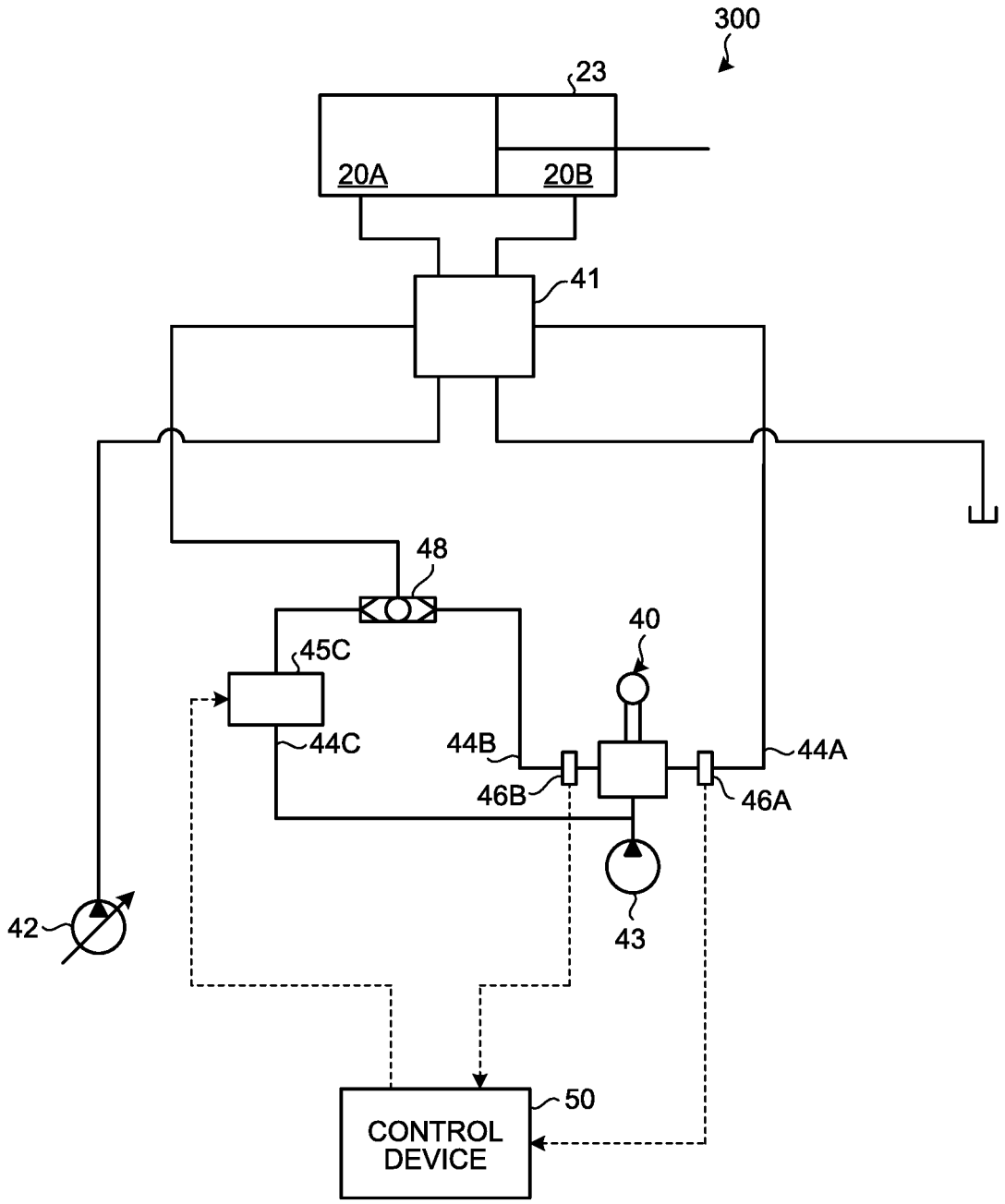
FIG. 5 is a diagram illustrating an example of a hydraulic system according to the present embodiment.

FIG. 5 is a diagram illustrating an example of the hydraulic system 300 operating the boom cylinder 23. Operation of the operation device 40 causes the boom 13 to perform two types of operations, that is, the rising operation and the lowering operation. The hydraulic system 300 operating the boom cylinder 23 includes the main hydraulic pump 42, a pilot pressure pump 43, the directional control valve 41, the operation device 40 for adjusting the pilot pressure applied to the directional control valve 41, the oil passages 44A, 44B, and 44C through which the pilot oil flows, a control valve 45C disposed in the oil passage 44C, pressure sensors 46A and 46B disposed in the oil passages 44A, 44B, and 44C, and the control device 50 for controlling the control valve 45C.

The control valve 45C is an electromagnetic proportional control valve. The control valve 45C adjusts the pilot pressure, on the basis of a command signal from the control device 50. The control valve 45C adjusts a pilot pressure in the oil passage 44C.

When the operation device 40 is operated, the pilot pressure is applied to the directional control valve 41 according to the operational amount of the operation device 40. The spool of the directional control valve 41 is moved according to the pilot pressure. On the basis of the movement amount of the spool, the amount of hydraulic oil to be supplied per unit time is adjusted, which is supplied from the main hydraulic pump 42 to the boom cylinder 23 through the directional control valve 41.

In the present embodiment, for the land leveling assist control, the control valve 45C is provided in the oil passage 44C. The control valve 45C is operated on the basis of a control signal relating to the land leveling assist control, output from the control device 50. The pilot oil delivered from the pilot pressure pump 43 flows in the oil passage 44C. The oil passage 44C and the oil passage 44B are connected to a shuttle valve 48. The shuttle valve 48 supplies the pilot oil in an oil passage having a higher pilot pressure, of the oil passage 44B and the oil passage 44C, to the directional control valve 41. The control valve 45C is controlled on the basis of the control signal output from the control device 50 to perform the land leveling assist control.

When the land leveling assist control is not performed, the control device 50 outputs no control signal to the control valve 45C to drive the directional control valve 41 on the basis of the pilot pressure adjusted by the operation of the operation device 40. For example, the control device 50 closes the oil passage 44C through the control valve 45C to drive the directional control valve 41 on the basis of the pilot pressure adjusted by the operation of the operation device 40.

When the land leveling assist control is performed, the control device 50 controls the control valve 45C to drive the directional control valve 41 on the basis of the pilot pressure adjusted by the control valve 45C. For example, when the land leveling assist control for restricting the movement of the boom 13 is performed, the control device 50 fully opens the control valve 45C to have a pilot pressure according to a boom target speed. When the pilot pressure in the oil passage 44C is larger than the pilot pressure in the oil passage 44B, the pilot oil from the control valve 45C is supplied to the directional control valve 41, through the shuttle valve 48. Thus, the boom cylinder 23 extends, and the boom 13 performs the rising operation.

The arm 12 performs two types of operations, that is, the excavation operation and the dumping operation. Extension of the arm cylinder 22 causes the arm 12 to perform the excavation operation, and retraction of the arm cylinder 22 causes the arm 12 to perform the dumping operation. Description of the hydraulic system 300 for operating the arm cylinder 22 will be omitted.

[Control System]

Figure 6:
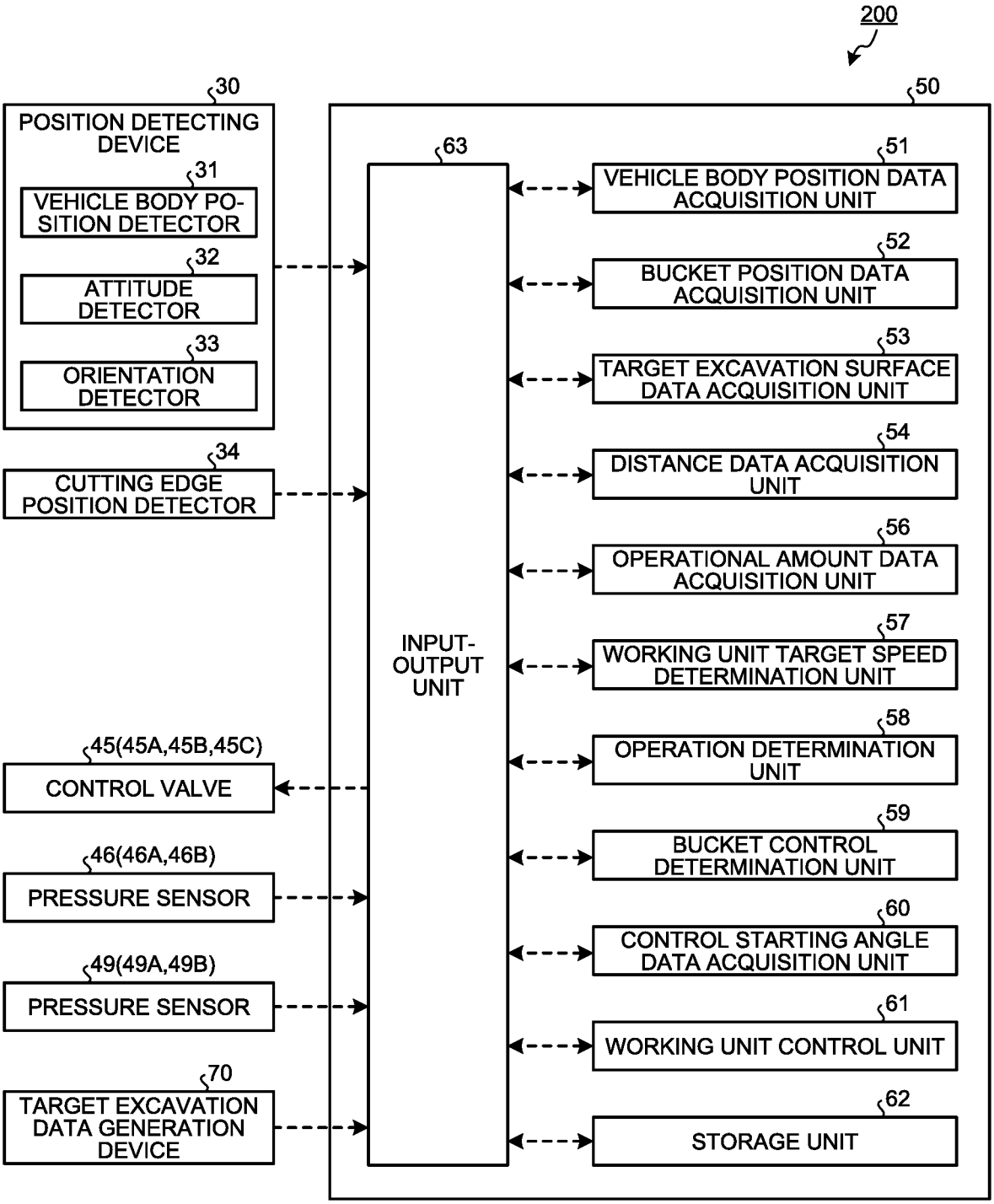
FIG. 6 is a functional block diagram illustrating an example of a control device according to the present embodiment.

Next, a control system 200 of the excavator 100 according to the present embodiment will be described. FIG. 6 is a functional block diagram illustrating an example of the control system 200 according to the present embodiment.

As illustrated in FIG. 6, the control system 200 includes the control device 50 for controlling the working unit 1, the position detecting device 30, the cutting edge position detector 34, the operation device 40, control valves 45 (45A, 45B, 45C), pressure sensors 46 (46A, 46B), pressure sensors 49 (49A, 49B), and a target excavation data generation device 70.

As described above, the position detecting device 30 including the vehicle body position detector 31, the attitude detector 32, and the orientation detector 33 detects the absolute position Pg of the upper swing body 2. In the following description, the absolute position Pg of the upper swing body 2 is appropriately referred to as vehicle body position Pg.

The control valves 45 (45A, 45B, 45C) adjust the amount of hydraulic oil to be supplied to the hydraulic cylinders 20. The control valves 45 are operated on the basis of the control signal from the control device 50. The pressure sensors 46 (46A, 46B) detect the pilot pressure in the oil passages 44 (44A, 44B). The pressure sensors 49 (49A, 49B) detect the pilot pressure in oil passages 47 (47A, 47B). The detection data from the pressure sensors 46 and the detection data from the pressure sensors 49 are output to the control device 50.

The target excavation data generation device 70 includes a computer system. The target excavation data generation device 70 generates target excavation data representing a three-dimensionally designed profile as a target shape of an area to be excavated. The target excavation data represents the three-dimensional target shape obtained after excavation by the working unit 1.

Note that the target excavation data generation device 70 and the control device 50 may be connected in a wired manner to transmit the target excavation data from the target excavation data generation device 70 to the control device 50. Note that the target excavation data generation device 70 may include a storage medium storing the target excavation data, and the control device 50 may have a device capable of reading the target excavation data from the storage medium.

The control device 50 has a vehicle body position data acquisition unit 51, a bucket position data acquisition unit 52, a target excavation profile data acquisition unit 53, a distance data acquisition unit 54, an operational amount data acquisition unit 56, a working unit target speed determination unit 57, an operation determination unit 58, a bucket control determination unit 59, and a control starting angle data acquisition unit 60, which are executed by the processor. The control device 50 includes a storage unit 62 storing the specification data of the excavator 100, which is achieved by the storage device. The control device 50 includes an input-output unit 63 constituting the input-output interface device.

The vehicle body position data acquisition unit 51 acquires vehicle body position data representing the vehicle body position Pg from the position detecting device 30, through the input-output unit 63. The vehicle body position detector 31 detects the vehicle body position Pg, on the basis of at least one of the installation position P1*a* and the installation position P1*b* of the GPS antennas 31. The vehicle body position data acquisition unit 51 acquires the vehicle body position data representing the vehicle body position Pg, from the vehicle body position detector 31.

The bucket position data acquisition unit 52 acquires bucket position data including a position of the cutting edge of the bucket 11, from the cutting edge position detector 34, through the input-output unit 56. The bucket position data acquisition unit 52 acquires the bucket position data including the position of the cutting edge, that is, the relative position of the cutting edge 10 with respect to the reference position Ps of the upper swing body 2, from the cutting edge position detector 34. The target excavation profile data acquisition unit 53 uses the target excavation data supplied from the target excavation data generation device 70, and the bucket position data to generate target excavation profile data representing a target shape of the object to be excavated, corresponding to a position of the bucket 11.

On the basis of the position of the bucket 11 acquired by the bucket position data acquisition unit 52, and the target excavation profile generated by the target excavation profile data acquisition unit 53, the distance data acquisition unit 54 calculates the distance D between the bucket 11 and the target excavation profile, and acquires distance data representing the distance D.

Note that the distance D between the bucket 11 and the target excavation profile may be a distance between the cutting edge 10 of the bucket 11 and the target excavation profile, or may be a distance between the target excavation profile and an arbitrary position of the bucket 11, including an outer peripheral surface of the bucket 11, which is calculated using external dimensional data of the bucket 11. For example, a distance between the bottom surface 17 of the bucket 11 and the target excavation profile may be employed as the distance D between the bucket 11 and the target excavation profile.

The operational amount data acquisition unit 56 acquires operational amount data representing an operational amount of the operation device 40 operating the working unit 1. An operational amount of the bucket 11, an operational amount of the arm 12, and an operational amount of the boom 13 correlate with the detection data from the pressure sensors 46. Correlation data representing correlations between the operational amounts of the working unit 1 and the detection data from the pressure sensors 46 are preliminarily obtained from a preliminary experiment or simulation, and stored in the storage unit 62. Note that the operational amounts may be acquired from detection values from angle sensors such as a potentiometer mounted to the levers.

The operational amount data acquisition unit 56 acquires operational amount data representing an operational amount of the operation device 40 operating the bucket 11, from the detection data from the pressure sensors 49A and 49B, on the basis of the detection data from the pressure sensors 49A and 49B, and the correlation data stored in the storage unit 62. Similarly, on the basis of detection signals from the pressure sensors 46A and 46B, and the correlation data stored in the storage unit 62, the operational amount data acquisition unit 56 acquires operational amount data representing an operational amount of the operation device 40 for operating at least one of the arm 12 and the boom 13, from the detection signals (PPC pressure) from the pressure sensors 46A and 46B.

The working unit target speed determination unit 57 determines a working unit speed limit representing a limit of an overall speed of the working unit 1, on the basis of the distance D between the bucket 11 and the target excavation profile. The overall speed of the working unit 1 represents an actual operation speed of the bucket 11, when the bucket 11, the arm 12, and the boom 13 are driven. Furthermore, the working unit target speed determination unit 57 determines the boom target speed on the basis of the distance D between the bucket 11 and the target excavation profile. In the present embodiment, on the basis of the working unit speed limit, and at least an arm operational amount and a bucket operational amount acquired by the operational amount data acquisition unit 56, the working unit target speed determination unit 57 calculates the boom target speed to offset a deviation between the overall speed of the working unit 1 and the working unit speed limit, caused based on the operation of the bucket 11 and the arm 12. In the land leveling assist control, the bucket 11 and the arm 12 are moved on the basis of the operation of the operation device 40 by the operator. In the land leveling assist control, the working unit target speed determination unit 57 determines the boom target speed of the boom 10 performing the rising operation to move the cutting edge 10 of the bucket 11 along the target excavation profile, while the operation device 40 operates the bucket 11 and the arm 12.

The operation determination unit 58 determines non-operation of the operation device 40 operating the bucket 11, on the basis of bucket operational amount data representing the operational amount of the operation device 40 operating the bucket 11. The non-operation of the operation device 40 operating the bucket 11 includes neutral operation in which the bucket 11 does not perform the excavation operation nor the dumping operation. The operation determination unit 58 determines whether a bucket operation lever is in the neutral position, on the basis of the detection data from the pressure sensors 49A and 49B.

The bucket control determination unit 59 determines whether bucket control conditions for performing the bucket control are satisfied, on the basis of the determination of the operation determination unit 58. In the present embodiment, the bucket control determination unit 59 determines whether the bucket control conditions are satisfied, on the basis of the distance data acquired by the distance data acquisition unit 54, and determination data of the operation determination unit 58. In the present embodiment, the bucket control conditions include non-operation of the operation device 40 for operating the bucket 11, the distance D not larger than the first threshold H1, and the arm 12 being driven.

The control starting angle data acquisition unit 60 acquires bucket control starting angle data representing the attitude of the working unit 1 upon determination of satisfaction of the bucket control conditions. That is, the control starting angle data acquisition unit 60 acquires attitude data of the working unit 1, when it is determined that the distance D is not larger than the first threshold H1, and the bucket operation lever for operating the bucket 11 is in the neutral position.

A working unit control unit 61 outputs a control signal for controlling the bucket 11 to maintain the state of the working unit 1, while the bucket control conditions are satisfied. The working unit control unit 61 outputs a control signal for performing the working unit control including the land leveling assist control and the bucket control, to the control valves 45A and 45B. In the present embodiment, while the bucket control conditions are satisfied, the working unit control unit 61 outputs a control signal for controlling the bucket cylinder 21, and performs the bucket control to maintain the attitude of the working unit 1 at the constant angle.

In the present embodiment, while the bucket control conditions are satisfied, the working unit control unit 61 determines a target angle of the bucket 11, and outputs a control signal so that a change in the sum of the attitude angle θ13 of the boom 13 and the attitude angle θ12 of the arm 12 is offset with the attitude angle θ11 of the bucket 11 to maintain the sum of the attitude angle θ13 of the boom 13, the attitude angle θ12 of the arm 12, and the attitude angle θ11 of the bucket 11, which define the attitude of the working unit 1.

Meanwhile, when the bucket control conditions are determined not to be satisfied, the bucket 11 is driven on the basis of the operation of the operation device 40.

Furthermore, when the distance D is determined to be not larger than a second threshold H2 which is larger than the first threshold H1, the working unit control unit 61 outputs a control signal for controlling the boom cylinder 23 for driving the boom 13, and performs the land leveling assist control to move the working unit 1 on the basis of the working unit speed limit.

Figure 7:
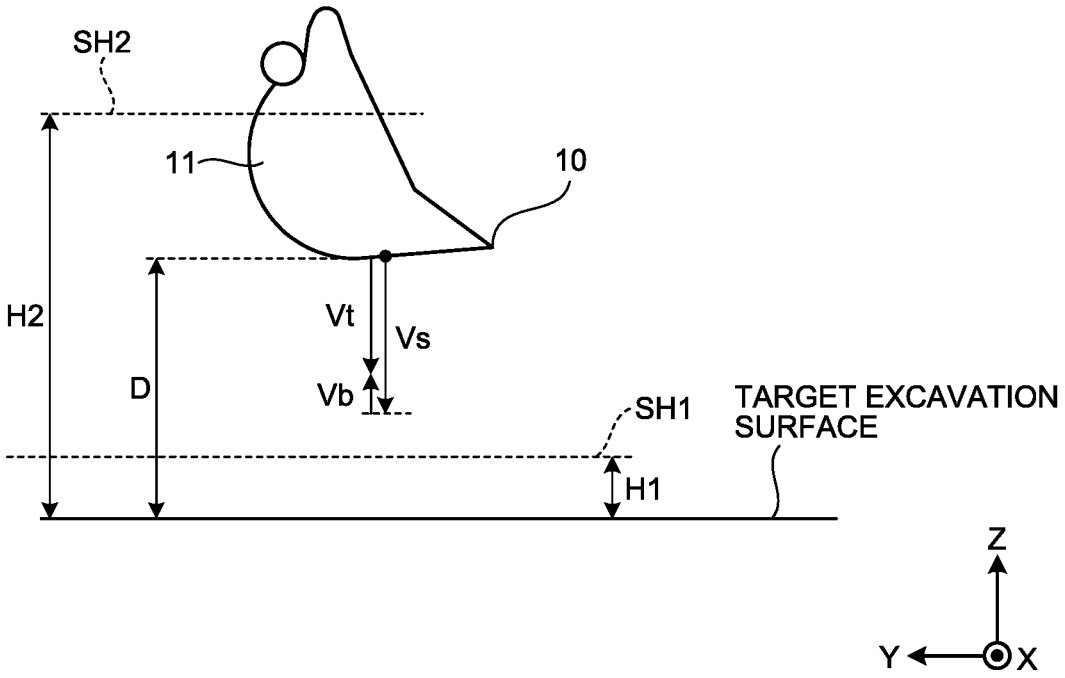
FIG. 7 is a schematic view illustrating land leveling assist control and bucket control according to the present embodiment.

FIG. 7 is a schematic view illustrating the land leveling assist control and the bucket control according to the present embodiment. First, the land leveling assist control will be described. As illustrated in FIG. 7, a speed limit intervention line SH2 is defined. The speed limit line SH2 is parallel with the target excavation profile, and is defined at a position away from the target excavation profile by a distance H2. The distance H2 is the second threshold of the distance D between the bucket 11 and the target excavation profile. The distance H2 is preferably set to maintain operator's operation feeling.

The distance data acquisition unit 54 acquires the distance D as a minimum distance between the target excavation profile and the bucket 11 in a normal direction of the target excavation profile. In an example illustrated in FIG. 7, the distance D is defined between the bottom surface of the bucket 11 and the target excavation profile. Furthermore, the working unit target speed determination unit 57 determines a working unit speed limit Vt as the limit of the overall speed of the working unit 1 for land leveling assist, according to the distance D.

Figure 8:
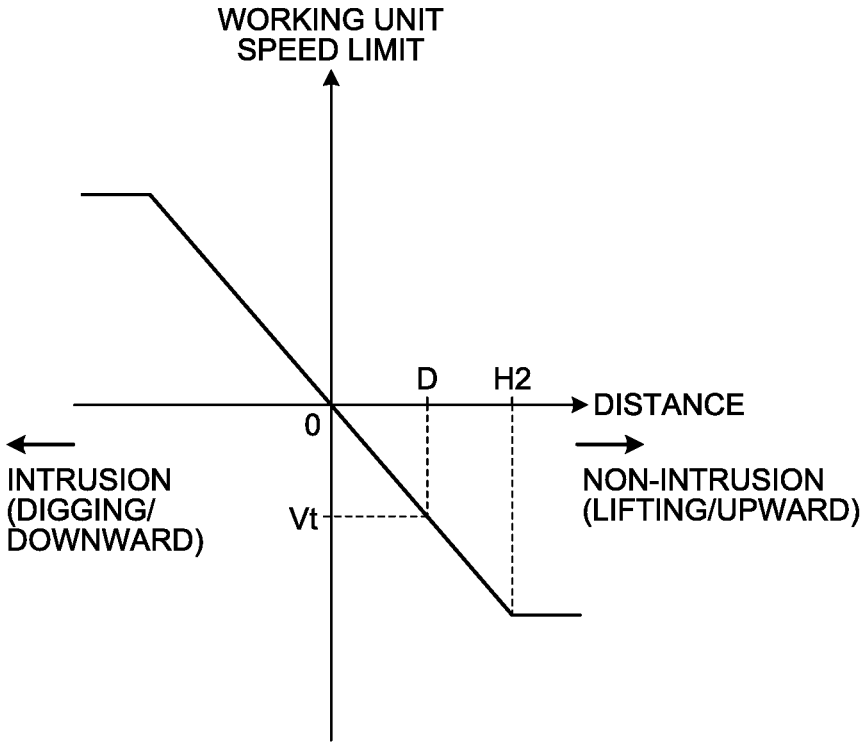
FIG. 8 is a graph illustrating an example of a relationship between distance and working unit speed limit according to the present embodiment.

FIG. 8 is a graph illustrating an example of a relationship between the second threshold H2 and the distance D, and a relationship between the distance D and the working unit speed limit Vt, according to the present embodiment. The working unit speed limit Vt is not set, when the distance D is larger than the second threshold H2, and is set, when the distance D is not larger than the second threshold H2. The smaller the distance D, the smaller the working unit speed limit Vt, and when the distance D is zero, the working unit speed limit Vt is also zero. In the present embodiment, a speed of the bucket 11 moving upward from under the target excavation profile is defined as a positive value, and a speed of the bucket 11 moving downward from above the target excavation profile is defined as a negative value. The working unit target speed determination unit 57 determines the working unit speed limit Vt so that the larger the distance D, the larger the absolute value of the working unit speed limit Vt, and the smaller the distance D, the smaller the absolute value of the working unit speed limit Vt.

Next, the bucket control will be described. The bucket control determination unit 59 determines whether the distance D is not larger than the first threshold H1, and the bucket operation lever is in the neutral operation. As illustrated in FIG. 7, the first threshold H1 for the bucket control is smaller than the second threshold H2 for the land leveling assist control.

For example, when the bucket 11 gradually approaches the target excavation profile by the operation of the operation device 40, the distance D between the bucket 11 and the target excavation profile is not larger than the first threshold H1, and the operator stops the operation of the bucket operation lever and the bucket operation lever is in the neutral operation, the bucket control determination unit 59 determines that the bucket control conditions are satisfied. When the distance D is not larger than the first threshold H1, and the operator stops the operation of the bucket operation lever and the bucket operation lever is in the neutral operation, the working unit control unit 61 starts the bucket control.

Since the control device 50 performs the land leveling assist control and the bucket control as described above, when, for example, at least one of the arm 12 and the boom 13 is driven to cause the bucket 11 to gradually approach the target excavation profile, and the distance D larger than the first threshold H1 is not larger than the first threshold H1, while the bucket operation lever is in the neutral position, the angle of the bucket 11 positioned at a distance D1 not larger than the first threshold H1 is maintained relative to the target excavation profile.

Furthermore, for example, when the bucket operation lever being operated is positioned in the neutral position, while the distance D is not larger than the first threshold H1, the working unit control including the bucket control and the land leveling assist control is performed so that the angle of the bucket 11 where the bucket operation lever is positioned in the neutral position is maintained relative to the target excavation profile.

In the present embodiment, the bucket control is performed on the basis of the attitude of the working unit 1 to maintain the state of the working unit 1. Note that in order to maintain the state of the working unit 1, the bucket control may be performed to maintain a relative angle between the bucket 11 and the target excavation profile. In this configuration, a vector may be defined on the basis of the shape of the bucket 11, or a normal vector may be defined relative to the target excavation profile, in order to perform the bucket control to maintain the relative angle.

[Method of Controlling Excavator]

Figure 9:
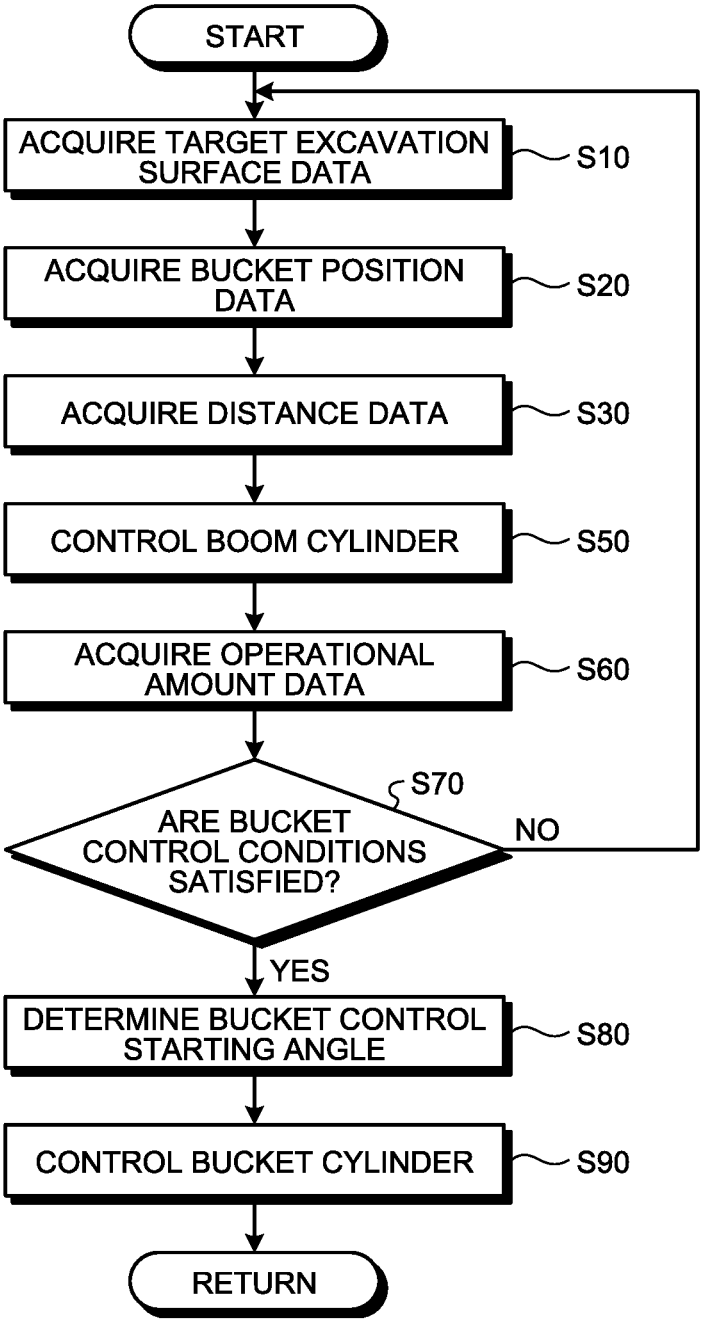
FIG. 9 is a flowchart illustrating an example of a method of controlling an excavator according to the present embodiment.

Next, a method of controlling an excavator 100 according to the present embodiment will be described with reference to FIG. 9. FIG. 9 is a flowchart illustrating the method of controlling the excavator 100 according to the present embodiment.

The target excavation data is supplied from the target excavation data generation device 70 to the control device 50. The target excavation profile data acquisition unit 53 acquires the target excavation data from the target excavation data generation device 70 (step S10).

The bucket position data is supplied from the cutting edge position detector 34 to the control device 50. The bucket position data acquisition unit 52 acquires the bucket position data from the cutting edge position detector 34 (step S20).

The distance data acquisition unit 54 calculates the distance data representing the distance D between the bucket 11 and the target excavation profile, on the basis of the target excavation profile acquired by the target excavation profile data acquisition unit 53, and the bucket position data acquired by the bucket position data acquisition unit 52 (step S30). Thus, the distance data between the bucket 11 and the target excavation profile is acquired.

The working unit target speed determination unit 57 determines a working unit speed limit Vr, on the basis of the distance data. Map data representing a relationship between the distance D and the working unit speed limit Vr, as described with reference to FIG. 8, is stored in the storage unit 62. The working unit target speed determination unit 57 determines the working unit speed limit Vr according to the distance D, on the basis of the distance data acquired by the distance data acquisition unit 54, and the map data stored in the storage unit 62.

The working unit target speed determination unit 57 calculates a boom target speed Vb for the land leveling assist control, on the basis of at least one of the determined working unit speed limit Vr, and the arm operational amount and the bucket operational amount acquired by the operational amount data acquisition unit 56.

When the distance D is not larger than the second threshold H2, the working unit control unit 61 outputs the control signal for controlling the boom cylinder 23 to the control valve 45C to move the boom 13 on the basis of the boom target speed Vb (step S50). Thereby, the land leveling assist control is started.

The operational amount data acquisition unit 56 acquires the operational amount data representing the operational amount of the operation device 40 operating the hydraulic cylinders 20 for driving the working unit 1 (step S60). In the present embodiment, the operational amount data acquisition unit 56 acquires the bucket operational amount data representing the operational amount of at least the bucket operation lever of the operation device 40. The operational amount data acquisition unit 56 can acquire the bucket operational amount data of the bucket operation lever, on the basis of the detection data from the pressure sensors 49A and 49B.

The operation determination unit 58 determines whether the operation device 40 performs predetermined operation, on the basis of the operational amount data acquired by the operational amount data acquisition unit 56. In the present embodiment, the operation determination unit 58 determines whether at least the bucket operation lever, of the operation device 40, as the operation device 40 operating the bucket 11, is not operated.

On the basis of the distance data acquired in step S30, and determination data representing whether the bucket operation lever is not operated, the bucket control determination unit 59 determines whether the bucket control conditions are satisfied, where the bucket control conditions include non-operation of the bucket operation lever of the operation device 40, the distance D not larger than the first threshold H1, and the arm 12 being driven (step S70).

In step S70, when the bucket control conditions are determined to be satisfied (step S70: Yes), the control starting angle data acquisition unit 60 acquires the bucket control starting angle data representing the attitude of the working unit 1 upon determination of satisfaction of the bucket control conditions. The working unit control unit 61 determines a bucket control starting angle in the bucket control, on the basis of the bucket control starting angle data acquired by the control starting angle data acquisition unit 60 (step S80).

While the bucket control conditions are satisfied, the working unit control unit 61 outputs the control signal for controlling at least the bucket cylinder 21, of the hydraulic cylinders 20, for driving the bucket 11 to maintain the attitude of the working unit 1 at a constant angle (step S90). In the present embodiment, the working unit control unit 61 outputs the control signal to the control valves 45A and 45B for controlling the bucket cylinder 21, and performs the bucket control.

Note that in step S70, when the bucket control conditions are determined not to be satisfied (step S70: No), the process returns to step S10. The hydraulic cylinders 20 are driven on the basis of operation of the operation device 40 by the operator.

[Functions and Effects]

As described above, according to the present embodiment, when the operation device 40 performs the predetermined operation and the bucket control conditions are satisfied, the bucket control for maintaining the attitude of the working unit 1 at the constant angle is automatically started. Thus, even if the operator does not perform special operation, the bucket control for maintaining the angle of the bucket 11 relative to the target excavation profile at the constant angle is automatically started.

Figure 10:
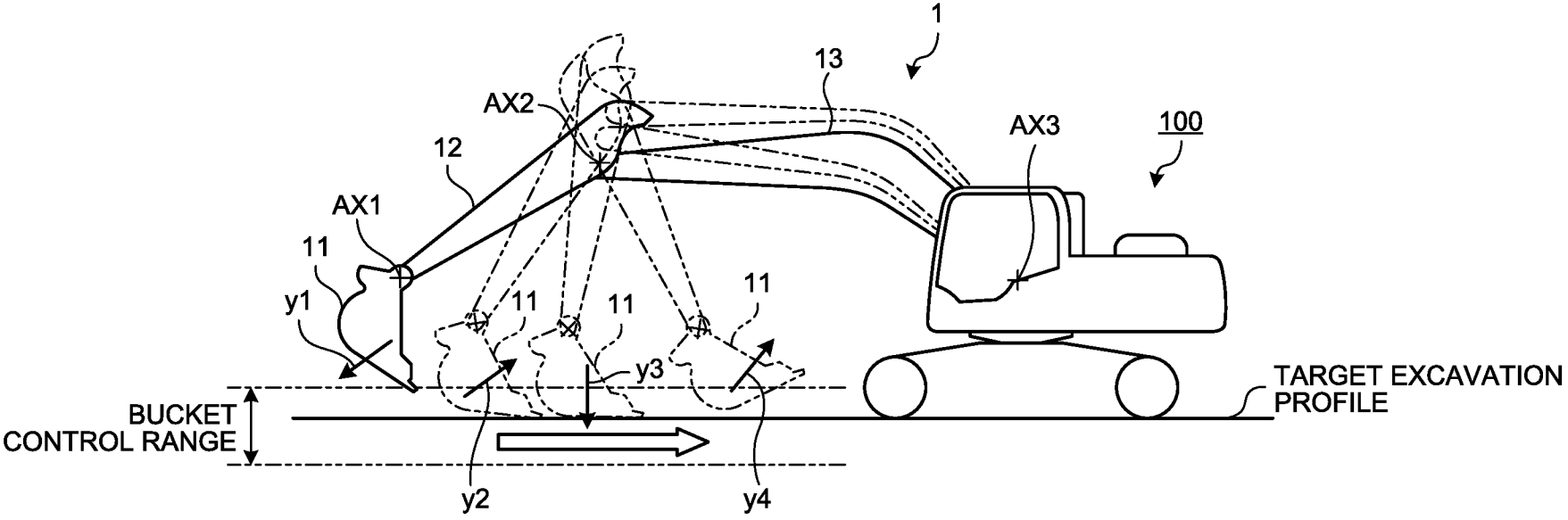
FIG. 10 is a schematic view illustrating effects of the control device according to the present embodiment.

FIG. 10 is a schematic view illustrating the effects of the control system 200 according to the present embodiment. As illustrated in FIG. 10, immediately after the bucket control is started, a height of the bucket 11 and the attitude angle θ11 of the bucket 11 are controlled on the basis of the bucket control, and the excavation is started, as indicated by an arrow y1. Next, the operator operates the bucket as needed, the bucket control is released, and the angle of the bucket is adjusted as indicated by an arrow y2. For example, when the operator desires to face the bottom surface 17 of the bucket 11 to the target excavation profile, the operator operates the bucket. Next, when the operator releases the operation of the bucket, excavation is performed on the basis of the bucket control, as indicated by an arrow y3. Finally, when the operator operates the bucket, the bucket control is released, and the angle of the bucket is adjusted as indicated by an arrow y4. For example, when the operator desires scooping by the bucket 11, the operator performs the bucket operation. As described above, the operator is required to perform operation of the bucket 11, only in an initial period or a terminal period of the excavation. In a period in which accuracy is required in excavation, even if the operator does not perform the operation of the bucket 11, the bucket control is performed, and the relative angle between the bucket 11 and the target excavation profile can be maintained. Thus, operability and accuracy in excavation are improved.

Furthermore, according to the present embodiment, when the bucket control conditions are satisfied, and the bucket control is automatically started, where the bucket control conditions include the non-operation of the operation device 40 for operating the bucket 11, the distance D between the bucket 11 and the target excavation profile being not larger than the first threshold H1, and the arm 12 being driven. Thus, even if the operator does not perform special operation, the bucket control for maintaining the angle of the bucket 11 relative to the target excavation profile at the constant angle is automatically started.

When the bucket control conditions, that is, the non-operation of the bucket operation lever of the operation device 40, the distance D not larger than the first threshold H1, and the arm 12 being driven, are satisfied, the bucket control is automatically started, and thus, the bucket control is started at an appropriate time to perform finish excavation.

Furthermore, when the bucket control conditions are determined not to be satisfied, the bucket control is not performed, and the hydraulic cylinders 20 are driven on the basis of the operation of the operation device 40. Thus, the operation of the operation device 40 by the operator can be reflected on driving of the bucket 11.

Furthermore, while maintaining the angle of the bucket 11, where the bucket control conditions are determined to be satisfied, the bucket control is performed. Thus, the operator is only required to return for example the bucket operation lever to the neutral position to set the angle of the bucket 11 in the bucket control.

Note that, in the embodiments described above, the operation device 40 is provided in the excavator 100. The operation device 40 may be provided at a remote place away from the excavator 100 to remotely control the excavator 100. When the working unit 1 is remotely controlled, a command signal representing the operational amount of the working unit 1 is wirelessly transmitted from the operation device 40 provided at the remote place to the excavator 100. The operational amount data acquisition unit 56 of the control device 50 acquires the wirelessly-transmitted command signal representing the operational amount.

Note that, in the embodiments described above, the construction machine 100 is the excavator 100. The control device 50 and the control method described in the above embodiments can be generally applied to construction machines having working units, in addition to the excavator 100.

REFERENCE SIGNS LIST

1 WORKING UNIT
2 VEHICLE BODY (UPPER SWING BODY)
3 TRAVEL UNIT (LOWER TRAVEL BODY)
4 CAB
4S DRIVER'S SEAT
5 MACHINE ROOM
6 HAND RAIL
7 TRACK
10 CUTTING EDGE
11 BUCKET
12 ARM
13 BOOM
14 BUCKET CYLINDER STROKE SENSOR
15 ARM CYLINDER STROKE SENSOR
16 BOOM CYLINDER STROKE SENSOR
17 BOTTOM SURFACE
20 HYDRAULIC CYLINDER
20A CAP SIDE OIL CHAMBER
20B ROD SIDE OIL CHAMBER
21 BUCKET CYLINDER
22 ARM CYLINDER
23 BOOM CYLINDER
30 POSITION DETECTING DEVICE
31 VEHICLE BODY POSITION DETECTOR
31A GPS ANTENNA
32 ATTITUDE DETECTOR
33 ORIENTATION DETECTOR
34 CUTTING EDGE POSITION DETECTOR
40 OPERATION DEVICE
41 DIRECTIONAL CONTROL VALVE
42 MAIN HYDRAULIC PUMP
43 SUB-HYDRAULIC PUMP
44A, 44B, 44C OIL PASSAGE
45A, 45B, 45C CONTROL VALVE
46A, 46B PRESSURE SENSOR
47A, 47B OIL PASSAGE
48 SHUTTLE VALVE
49A, 49B PRESSURE SENSOR
50 CONTROL DEVICE
51 VEHICLE BODY POSITION DATA ACQUISITION UNIT
52 BUCKET POSITION DATA ACQUISITION UNIT
53 TARGET EXCAVATION PROFILE DATA ACQUISITION UNIT
54 DISTANCE DATA ACQUISITION UNIT
56 OPERATIONAL AMOUNT DATA ACQUISITION UNIT
57 WORKING UNIT TARGET SPEED DETERMINATION UNIT
58 OPERATION DETERMINATION UNIT
59 BUCKET CONTROL DETERMINATION UNIT
60 CONTROL STARTING ANGLE DATA ACQUISITION UNIT
61 WORKING UNIT CONTROL UNIT
62 STORAGE UNIT
63 INPUT-OUTPUT UNIT
70 TARGET EXCAVATION DATA GENERATION DEVICE
100 EXCAVATOR (CONSTRUCTION MACHINE)
200 CONTROL DEVICE
300 HYDRAULIC SYSTEM
AX1 ROTATION AXIS
AX2 ROTATION AXIS
AX3 ROTATION AXIS
L11 LENGTH
L12 LENGTH
L13 LENGTH
Pb ABSOLUTE POSITION OF CUTTING EDGE
Pg ABSOLUTE POSITION OF VEHICLE BODY
RX SWING AXIS
θ11 ATTITUDE ANGLE
θ12 ATTITUDE ANGLE
θ13 ATTITUDE ANGLE

The invention claimed is:

1. A control device for a construction machine including a working unit including at least a bucket connected to an arm, the control device for a construction machine comprising:

an operational amount data acquisition unit configured to acquire operational amount data indicating an operational amount of the working unit;

an operation determination unit configured to determine a non-operation state of the bucket on the basis of the operational amount data;

a distance data acquisition unit configured to acquire distance data indicating a distance between the bucket and a target excavation profile;

a bucket control determination unit configured to determine whether bucket control conditions are satisfied, on the basis of determination of the non-operation state; and a working unit control unit configured, when the bucket control conditions are determined to be satisfied, to output a control signal for controlling the bucket to maintain an attitude of the working unit of when the bucket control conditions are determined to be satisfied, wherein the bucket control conditions include the distance between the bucket and the target excavation profile is not larger than a first threshold, and the arm being driven.

2. The control device for the construction machine according to claim 1, wherein the working unit further includes a boom and an arm, and the state of the working unit maintained when the bucket control conditions are satisfied is an attitude of the working unit.

3. The control device for the construction machine according to claim 2, further comprising:

a control starting angle data acquisition unit configured to acquire bucket control starting angle data indicating an attitude of the working unit when the bucket control conditions are determined to be satisfied, wherein the working unit control unit outputs a control signal for controlling an angle of the bucket to maintain, at the bucket control starting angle, the attitude of the working unit when the bucket control conditions are satisfied.

4. The control device for the construction machine according to claim 1, wherein when the bucket control conditions are determined not to be satisfied, the working unit is driven on the basis of operation of the operation device.

5. The control device for the construction machine according to claim 1, further comprising:

a working unit target speed determination unit configured to determine a speed limit of the working unit on the basis of the distance, wherein when the distance between the bucket and the target excavation profile is determined to be not larger than a second threshold which is larger than the first threshold, the working unit control unit outputs a control signal for controlling the boom to move the working unit on the basis of the speed limit.

6. A method of controlling a construction machine including a working unit including at least a bucket, the method of controlling a construction machine comprising:

acquiring operational amount data indicating an operational amount of the working unit;

determining a non-operation state of the bucket on the basis of the operational amount data;

acquiring distance data indicating a distance between the bucket and a target excavation profile;

determining whether bucket control conditions are satisfied, on the basis of determination of the non-operation state; and outputting a control signal for controlling the bucket to maintain an attitude of the working unit of when the bucket control conditions are determined to be satisfied, wherein the bucket control conditions include the distance between the bucket and the target excavation profile is not larger than a first threshold, and the arm being driven.

* * * * *